US011298608B2

(12) United States Patent
Crennen et al.

(10) Patent No.: US 11,298,608 B2
(45) Date of Patent: Apr. 12, 2022

(54) GAME PIECE AND METHOD OF MANUFACTURE

(71) Applicant: Dungeon in a Box, LLC, Sherman Oaks, CA (US)

(72) Inventors: David Allen Crennen, Studio City, CA (US); Roman Banfield, Studio City, CA (US)

( * ) Notice: Subject to any disclaimer, the term of this patent is extended or adjusted under 35 U.S.C. 154(b) by 0 days.

(21) Appl. No.: 16/992,387

(22) Filed: Aug. 13, 2020

(65) Prior Publication Data

US 2022/0047935 A1 Feb. 17, 2022

(51) Int. Cl.
*A63F 3/00* (2006.01)

(52) U.S. Cl.
CPC *A63F 3/00697* (2013.01); *A63F 2003/00889* (2013.01); *A63F 2003/00892* (2013.01)

(58) Field of Classification Search
CPC ..... A63F 3/00697; A63F 2003/00889; A63F 2003/00892; A63H 3/08; A63G 3/10; A63G 3/50; A63G 33/42; B44C 5/04; B41M 5/0047
See application file for complete search history.

(56) References Cited

U.S. PATENT DOCUMENTS 1,839,889 A 1/1932 Palais
1,890,269 A 12/1932 Swanson
1,973,564 A 9/1934 Graham
2,097,267 A * 10/1937 Warren ..... A63H 3/50 446/387
2,196,861 A * 4/1940 Gruber ..... A63F 3/00697 273/282.1
3,874,975 A 4/1975 Lagain
(Continued)

FOREIGN PATENT DOCUMENTS

CN 1860258 B 8/2003
EP 0343310 A1 5/1988
(Continued)

OTHER PUBLICATIONS

Arcknight (NPL—YouTube video published Nov. 18, 2018 at https://www.youtube.com/watch?v=PaLJSE1IPUA) (Year: 2018).*
(Continued)

*Primary Examiner* — Michael D Dennis
(74) *Attorney, Agent, or Firm* — Williams Intellectual Property; Benjamin F. Williams

(57) ABSTRACT

A game piece and method of manufacture includes a generally planar transparent carrier approximately 1 to 4 mm thick. A front view of a detailed character image is printed on the reverse side of the carrier, which is visible through the carrier obverse side. An opaque silhouette of a neutral color is superimposed upon the character image front view and a rear view of the character image is printed superimposed upon the opaque silhouette. The carrier is then cut from a substrate with a perimetric edge outlining the character image. A foot portion is included, projected upon from the lowermost portion of the perimetric edge. A base portion is included, cut from a similar substrate. The base portion includes a slot into which the foot portion of the carrier securably inserts. The result is a lightweight, packable, transportable, and detailed game piece operable in an associated game space.

8 Claims, 13 Drawing Sheets

(56) References Cited

U.S. PATENT DOCUMENTS

| | | | | |
|---|---|---|---|---|
| 5,148,196 | A | 9/1992 | Spector | |
| 5,273,607 | A * | 12/1993 | O'Scanlon | A63H 33/009 156/277 |
| 5,421,583 | A | 6/1995 | Gluck | |
| 5,622,587 | A | 4/1997 | Barthelman | |
| 5,894,048 | A | 4/1999 | Eckart et al. | |
| 6,136,400 | A * | 10/2000 | Katayose | A63H 3/08 428/40.1 |
| 6,439,953 | B1 * | 8/2002 | Liu | A63H 3/08 434/259 |
| 6,475,054 | B1 * | 11/2002 | Liu | A63H 3/10 446/387 |
| 6,575,803 | B1 | 6/2003 | Liu | |
| 6,659,463 | B2 | 12/2003 | Mackey | |
| 7,290,767 | B2 | 11/2007 | Wilk et al. | |
| 7,364,487 | B2 | 4/2008 | Evans et al. | |
| 7,727,634 | B2 | 6/2010 | Yacovone | |
| 7,900,827 | B2 | 3/2011 | Albers et al. | |
| 2003/0071414 | A1 | 4/2003 | Weisman | |
| 2004/0144472 | A1 | 7/2004 | Cowie | |
| 2005/0167919 | A1 | 8/2005 | Grant et al. | |
| 2005/0189715 | A1 | 9/2005 | Shideler et al. | |
| 2007/0087651 | A1 | 4/2007 | Ali | |
| 2007/0176363 | A1 | 8/2007 | Bielman | |
| 2008/0023913 | A1 | 1/2008 | Barthold et al. | |
| 2008/0048396 | A1 | 2/2008 | Andersen | |
| 2009/0286450 | A1 | 11/2009 | Gary et al. | |
| 2014/0084542 | A1 | 3/2014 | Ziran et al. | |
| 2014/0335958 | A1 * | 11/2014 | Weisman | A63F 13/00 463/37 |
| 2015/0151194 | A1 | 6/2015 | Ziran et al. | |
| 2017/0007938 | A1 * | 1/2017 | Brooks | A63H 33/086 |
| 2017/0065879 | A1 | 3/2017 | Barney et al. | |
| 2020/0039190 | A1 * | 2/2020 | Lenaerts | B32B 27/304 |
| 2021/0221157 | A1 * | 7/2021 | Schwendimann | B41M 5/0256 |

FOREIGN PATENT DOCUMENTS

| | | | |
|---|---|---|---|
| EP | 1660203 | B1 | 4/2004 |
| EP | 2456619 | A1 | 7/2010 |
| WO | 2004024254 | A1 | 3/2004 |
| WO | 2014047535 | A1 | 3/2014 |

OTHER PUBLICATIONS

Susan L. Bell, Process Economics Program, Report 265A Bio-Based Polymers, published Aug. 2013, available at: https://ihsmarkit.com/pdf/RP265A_toc_173866110917062932.pdf.

Arcknight,Flat Plastic Miniatures, Fort Worth, TX, available at http://arcknight.squarespace.com/shop?category=Flat+Plastic+Miniatures.

Laser Cut Plastic chess set, https://www.ponoko.com/blog/design-ideas/laser-cut-chess-set/.

Gale Force 9, Plastic figures with irregular outline, https://www.tabletopgamingnews.com/gf9-releases-hercolix-green-power-barriers.

Laser cut games piece, Kickstarter campaign: https://www.kickstarter.com/projects/cloudpixies/laser-cut-acrylic-stand-up-game-character?ref=discovery&term=rpg%20token.

Youtube video of gamer making paper cutout game pieces: https://www.youtube.com/watch?v=VWWu9Ny8cW8.

Article about Flat Minis: https://spikeybits.com/2016/09/flat-gaming-minis-2d-takes-tabletop-by-storm.html.

Kickstarter page for Flat Plastic Minatures 2 (ArcKnight): https://www.kickstarter.com/project/arcknight/flat-plastic-miniatures-2.

Paizo Pawns: https://paizo.com/products/btq0206t?Pathfinder-Bestiary-Pawn-Box.

Reddit thread on ArcKnight Plastic Minis: https://www.reddit.com/r/dndnext/comments/98kffu/do_flat_plastic_minis_hold_up/.

* cited by examiner

GAME PIECE AND METHOD OF MANUFACTURE

BACKGROUND OF THE INVENTION

Role playing games incorporate characters that often acquire additional attributes and features as gameplay ensues. Different characters are encountered during the course of turns marking gameplay, many of which are enumerated literarily, or as part of a deck of cards or other instrument wherein new characters and characteristics may be listed for recital by the dungeon master. Further, role playing games typically occur on an evolving landscape where the board—or game space—changes as the story framing the gameplay is developed.

Many game pieces for role playing games are adaptable by a player holding a card that informs the character with a particular attribute, for example, or allows use of a different die or randomizing element employable during a turn when odds will dictate between mutually exclusive outcomes.

The culture surrounding role playing games is rich and diverse. Many games offer collectable characters and game pieces that may be customized to accommodate receipt of attributes, and many employ cards and the like to display pictorial characters and monsters with which the players will engage and which can be used to increase the variety of the gameplay with new characters and abilities as may be encountered or acquired. A great many of such elements are collectable.

What is needed, however, is a means of producing a variety of game pieces for incorporation into gameplay upon an evolving board, pieces that are readily producible in diversity, that are lightweight and portable and adaptable to include additional features where relevant (such as wings additional to a monster, for example, or a steed additional to a player's game piece), while evincing a visual representation as rich and detailed as a printed image that is distributable and informed literarily.

FIELD OF THE INVENTION

The present invention relates to novel game pieces and a method of manufacture that allows for production of an endless variety of game pieces that are lightweight, portable, well-appointed in visual detail, storable in bulk by stacking, and which pieces can be incorporated into standardized gameplay across evolving game spaces at standardized sizes, including characters and structures which employ common universal attributes particular to the gameplay, such as a base sized to show a move ability or inclusion of a supplemental slot into which additional and interchangeable elements and features may be fit when occasion demands (such as addition of wings to a beast, or steed, say, or a slot into which a weapon can be put where such a weapon is acquired or altered by some action as occurs during gameplay).

SUMMARY OF THE INVENTION

The present invention relates to a novel game piece having a printed character image displayed visibly through a transparent carrier as well as a method of manufacturing said game piece whereby an endless variety of characters are producible for gameplay at standardized sizes for use on an associated game space. The game pieces producible by the present method are devised to visually represent a high level of detail to define the particular character represented as a printed image while providing the tactile representation a three-dimensional game piece allows in use during gameplay. The game piece further is mountable into a base that includes dimensions equivalent to a move ability, to position the game piece erect in the game space over an associated and evolving board. The game pieces are lightweight and readily storable in stacks to conserve space and enable portability between locations where game play may occur.

The game piece presents a visually detailed rendering of a character image through a translucent carrier. The carrier is a Perspex®, acrylic, or translucent polymeric substrate, approximately 1 to 4 mm thick. The height and breadth of the carrier varies, depending on the character printed to the carrier. The carrier is cut to outline the character depicted thereon, essentially closely surrounding the silhouette of the character to define an irregular boundary in outline.

The character image is printed to the reverse side of the carrier such that a front view of the character is rendered visible through the obverse side of the carrier. The translucency of the carrier may therefore magnify the character image, refract the character image, or otherwise enhance the visual appearance of the character image, or render the character image more visible at various angles of view.

The character image is then superimposed on the reverse surface with an opaque silhouette overlay. A rear view of the character image is then printed to superimpose over the opaque overlay. The reverse surface of the carrier thereby presents a rear view of the character with the front view still visible through the obverse side of the carrier.

The carrier includes a foot portion projected at the lowermost edge of the carrier. The foot portion is devised to seat into a slot disposed upon a base portion whereby the game piece is erectable to support the carrier in an upright position for gameplay. In an example embodiment contemplated herein, the base portion is devised at standardized sizes to correspond with a move ability associated with the game space wherein the game piece is caused to operate during game play. The game space is contemplated to include a grid in which the game pieces are caused to move. In the example embodiment contemplated herein, the base portion of each game piece is sized corresponding to the grid employed over the game space. For example, the base portion of a typical game piece may include a diameter that equals the length of a grid square, whereby the base portion fits interior to each square that the grid imposes upon the game space. For some game pieces, however, the diameter of the base portion may be four times the diameter of the typical base portion, for example, signaling that for the associated game piece, the move ability is four times that of the typical piece. Base portions are also interchangeable, and thus may represent the acquisition of abilities attributable to the character. Such abilities may nonetheless be inferred or represented in other and additional ways, irrespective of the associated base portion attached to the game piece.

In an example embodiment contemplated herein, the base portion is a circular disk having a thickness of approximately 1 to 4 mm. The slot is cut along a section of the diameter. In at least one embodiment contemplated herein, the slot may narrow towards one end whereby positioning of the foot of an associated game piece is tensioned into the narrowing of the slot to thereby better secure the game piece in position attached therein. In another example embodiment contemplated as part of this invention, the slot may include at least one adjacent cut disposed through the base laterally proximal to the slot. In such embodiments, the at least one adjacent cut enables the slot to flex sufficiently to tautly accommodate the foot of an associated game piece, despite micro variances of thickness between game pieces as may result during manufacture. The at least one cut may include a pair of cuts disposed curved between a first end and a second end that are typically curved away from the slot. Further detail in this regard is set forth in the detailed description of the drawings below.

Game pieces may further include at least one supplemental slot cut into them. The supplemental slot may engage with an additional game piece element that is devised to insert therein. Thus, for example, a steed or beast of some kind may include a supplemental slot into which another humanoid game piece is devised to engage to signify the steed or beast is under the control of a rider, for example. Additional features may include, for example, the attainment of wings, slidable into a supplemental slot upon a beast or steed or other game piece whereby the game piece is possessed of wings. Other features, such as weapons, for example, or other features indicative of abilities, may likewise be rendered for addition to certain game pieces having at least one supplemental slot.

Thus has been broadly outlined the more important features of the present game piece and method of manufacture so that the detailed description thereof that follows may be better understood and in order that the present contribution to the art may be better appreciated.

Objects of the present game piece and method of manufacture, along with various novel features that characterize the invention are particularly pointed out in the claims forming a part of this disclosure. For better understanding of the game piece and method of manufacture, its operating advantages and specific objects attained by its uses, refer to the accompanying drawings and description.

BRIEF DESCRIPTION OF THE DRAWINGS

FIGURES

Figure 1A:
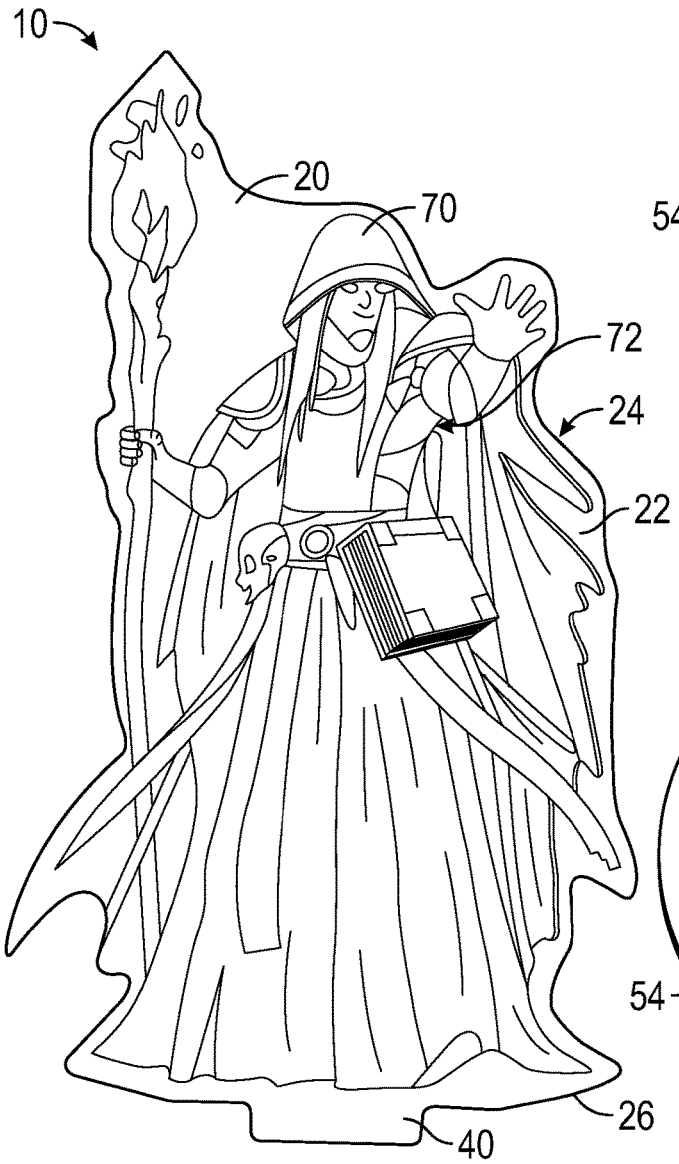

FIG. 1A is front elevation view of an example embodiment of a carrier

FIG. 1 B is a top elevation view of an example embodiment of an associated base portion.

Figure 1B:
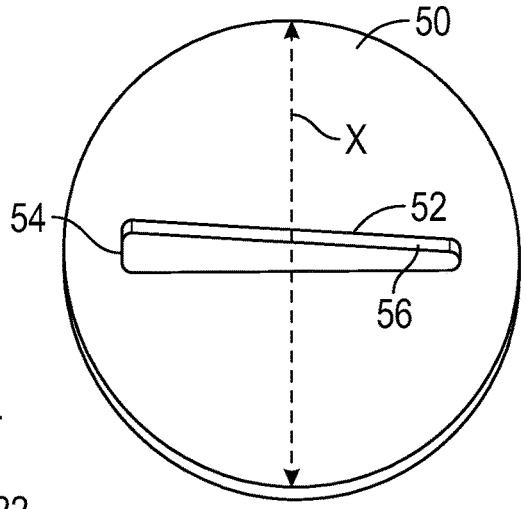
Figure 1C:
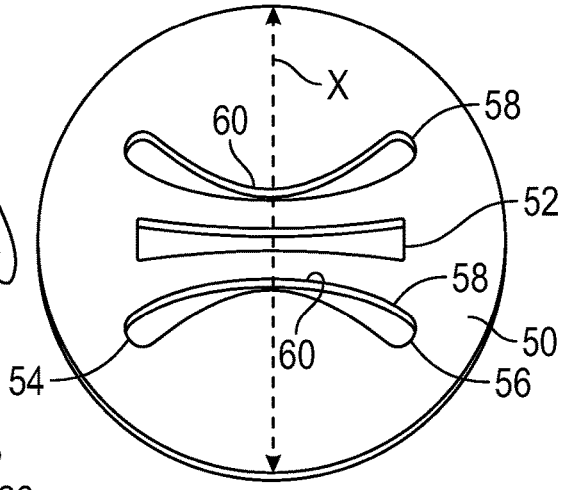

FIG. 1C is a top elevation view of an example embodiment of an associated base portion.

Figure 2:
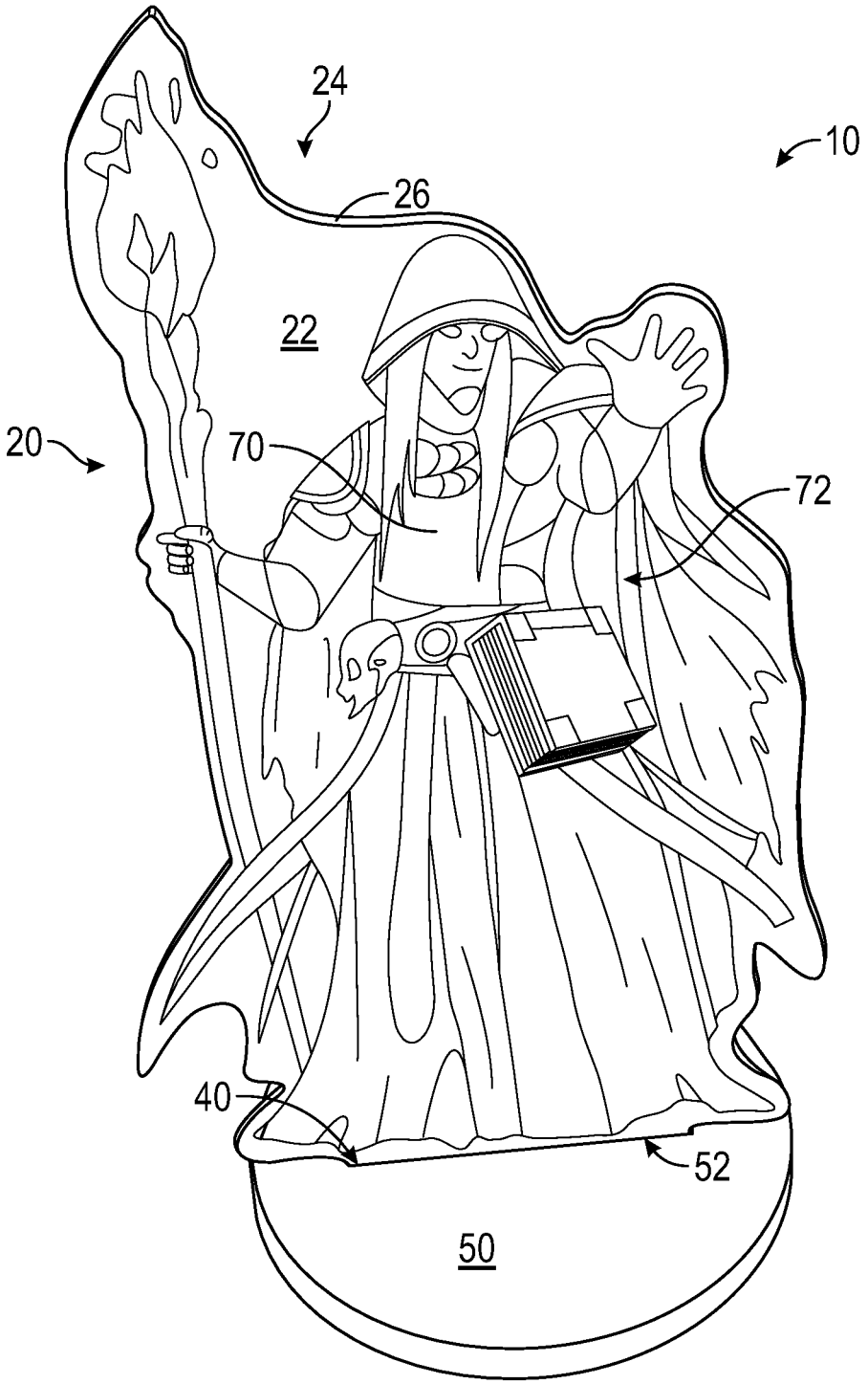

FIG. 2 is a front elevation view of the carrier of FIG. 1 installed into the base portion.

Figure 3:
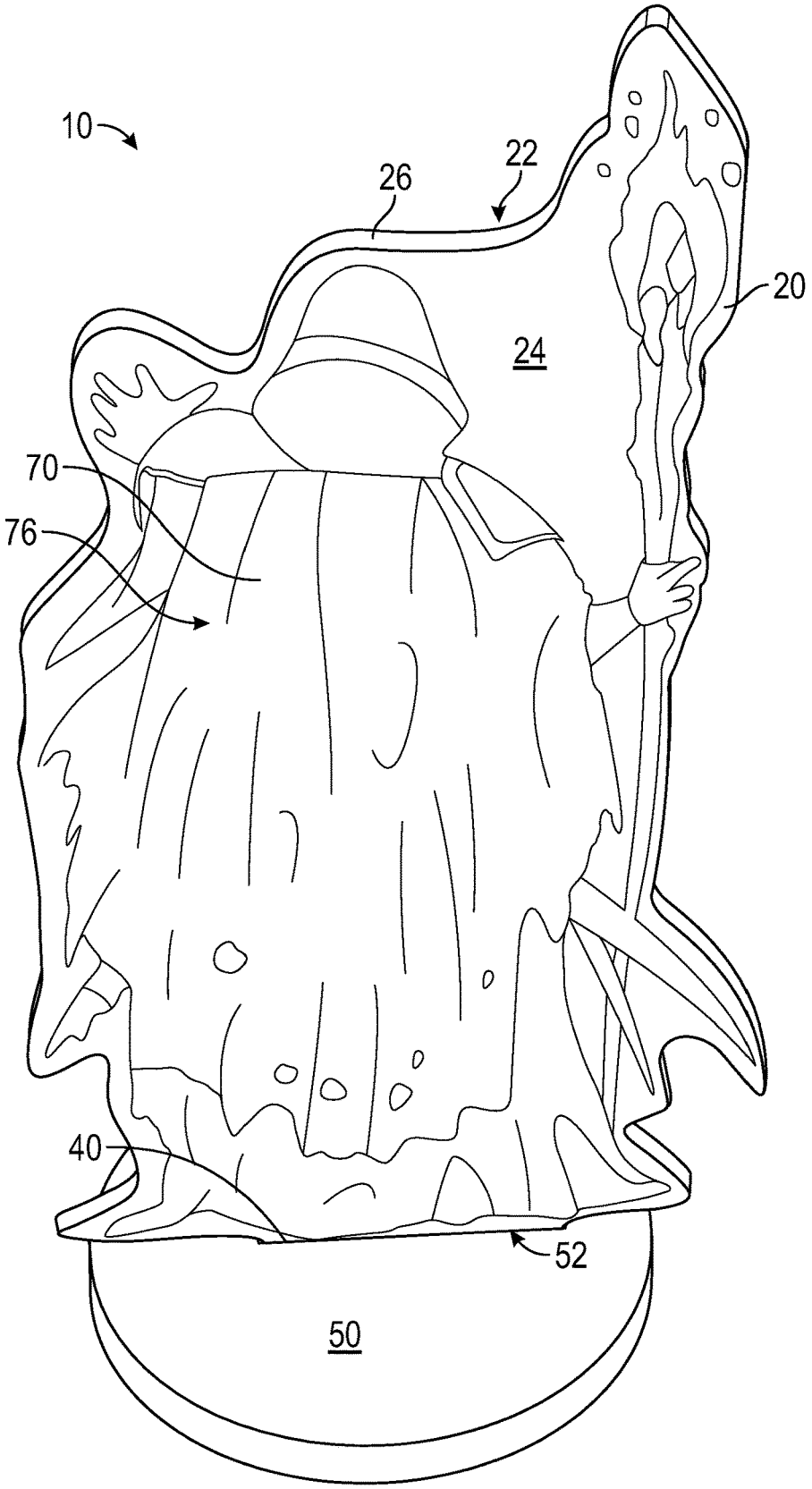

FIG. 3 is a rear elevation view of the example embodiment of FIG. 1 installed into the base portion.

Figure 4:
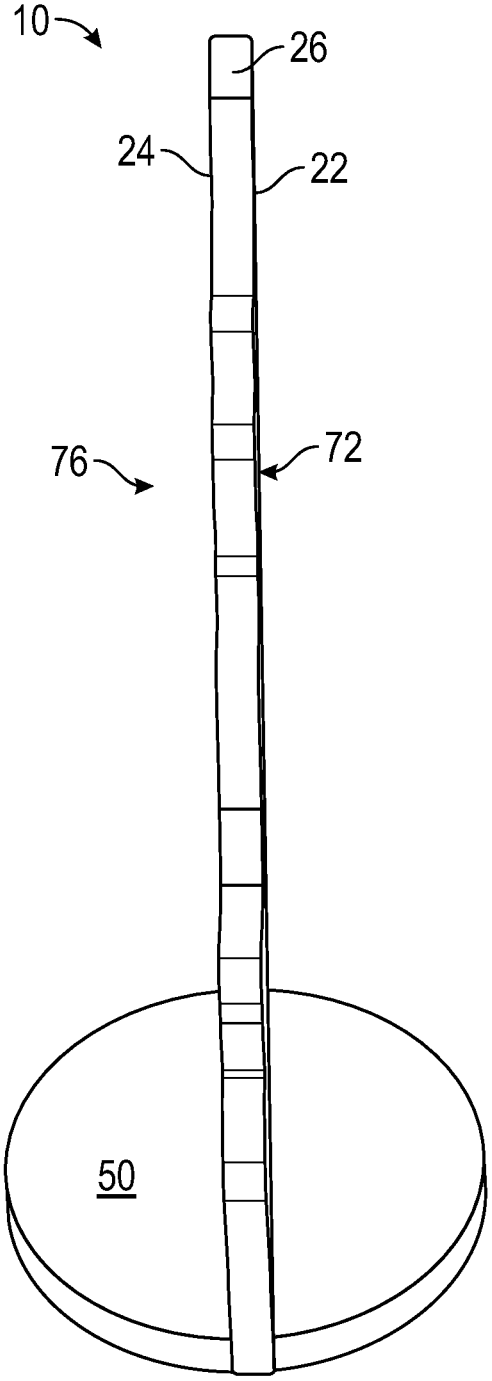

FIG. 4 is a side elevation view of the example embodiment of FIG. 1 installed into the base portion.

Figure 5:
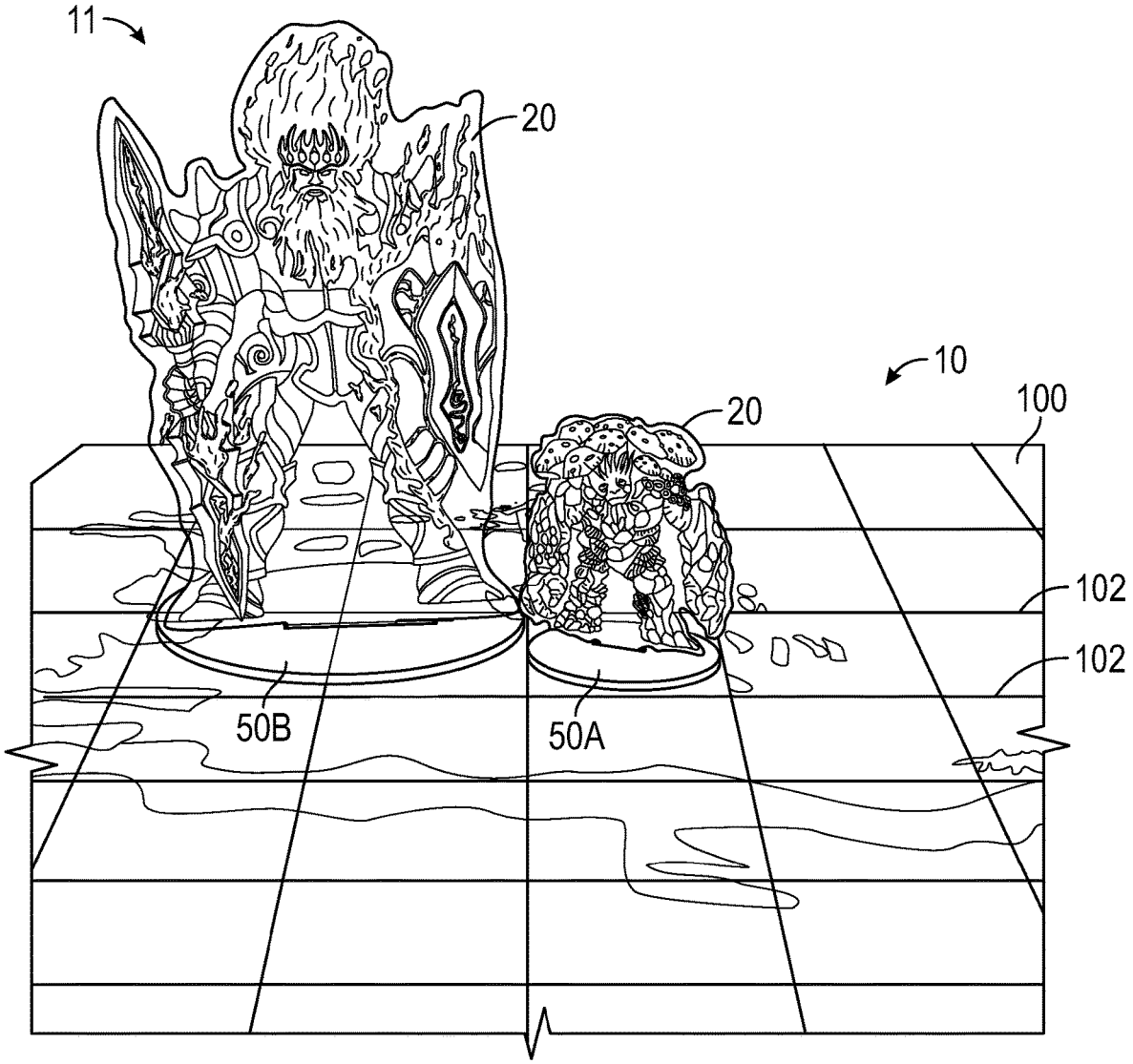

FIG. 5 is a front elevation view of an example embodiment of a pair of game pieces installed into associated base portions of different diameters and disposed upon a game space.

Figure 6:
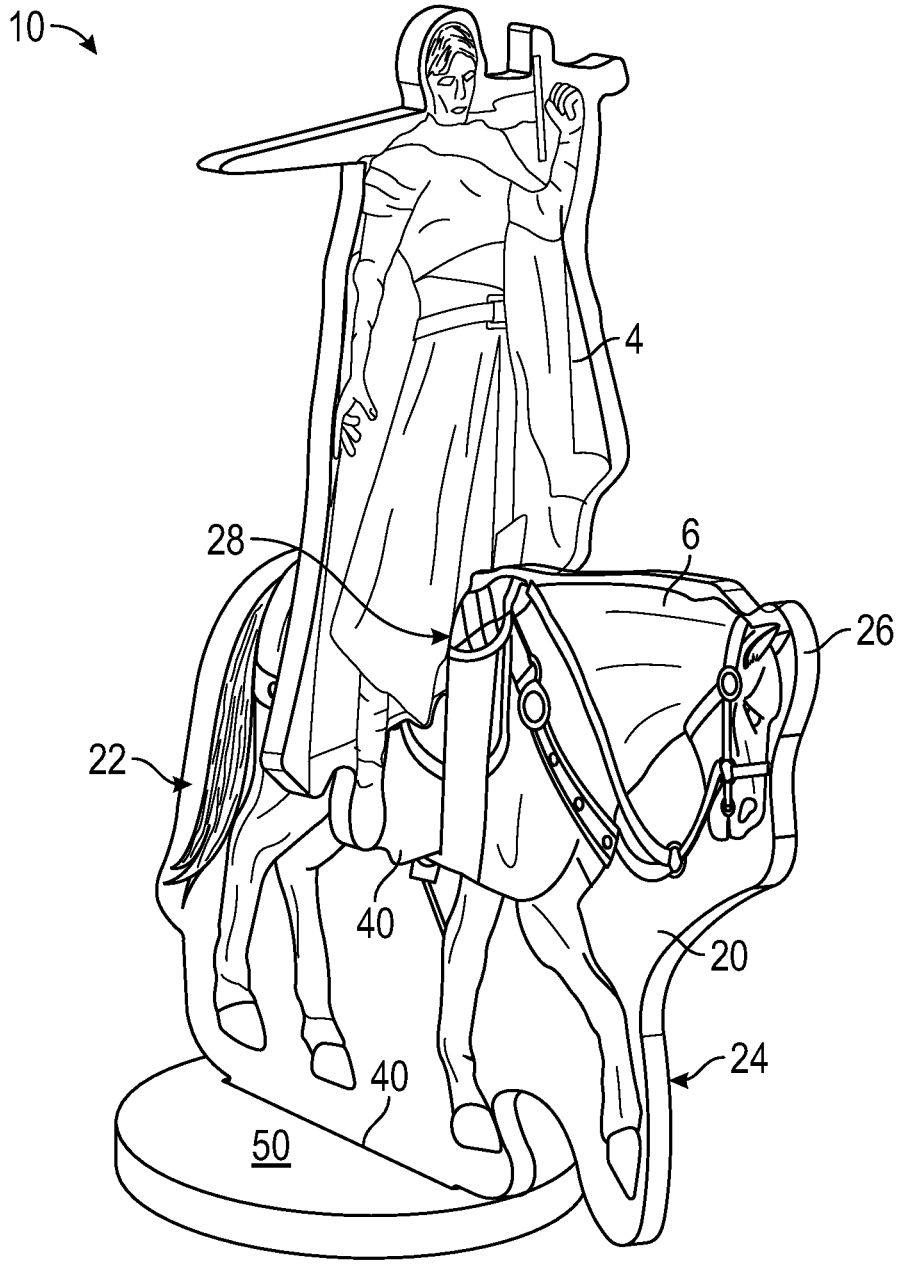

FIG. 6 is a diagonal elevation view of an example embodiment of a game piece slotted into a slot disposed upon another game piece as a rider of that said other game piece.

Figure 7:
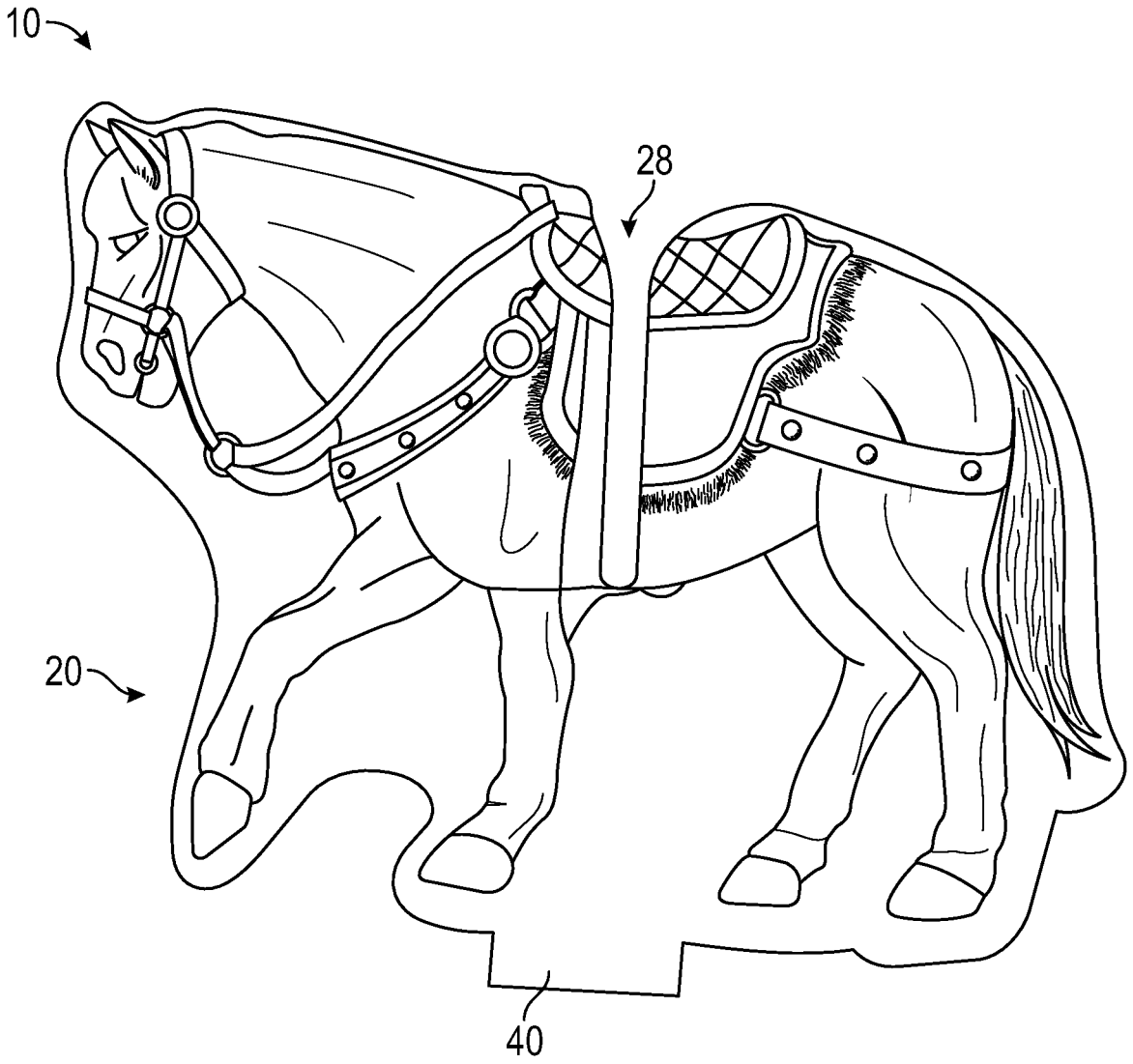

FIG. 7 is a font elevation view of an example embodiment of a game piece having a slot disposed in the body thereof for accommodation of another game piece therein, to denote the acquisition of a rider or of another special ability.

Figure 8:
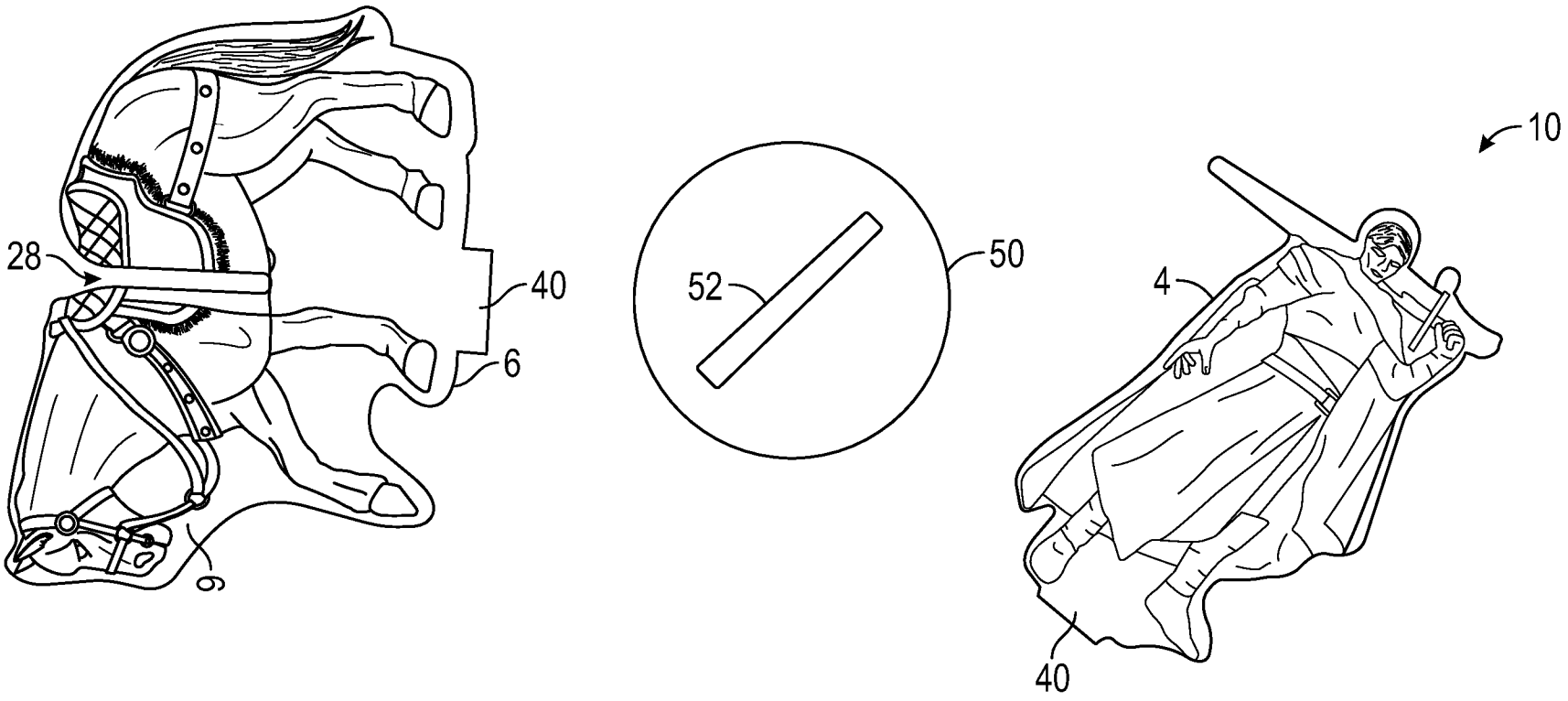

FIG. 8 is a raised elevation view of the example embodiment shown in FIG. 6 disassembled.

Figure 9A:
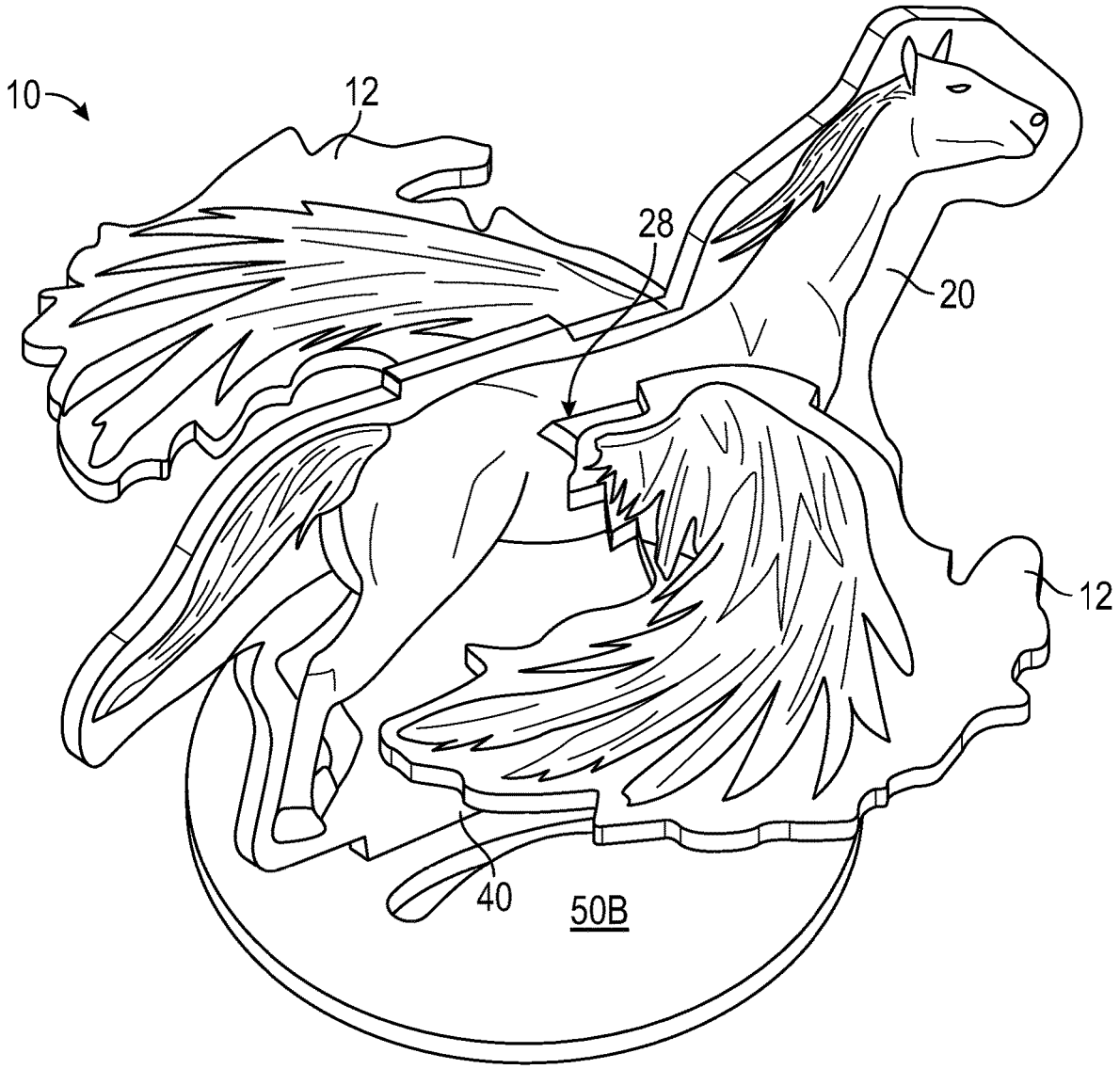

FIG. 9A is an elevation view of an example embodiment of a game piece having a slot disposed in the body for the inclusion of each of a pair of wings.

Figure 9B:
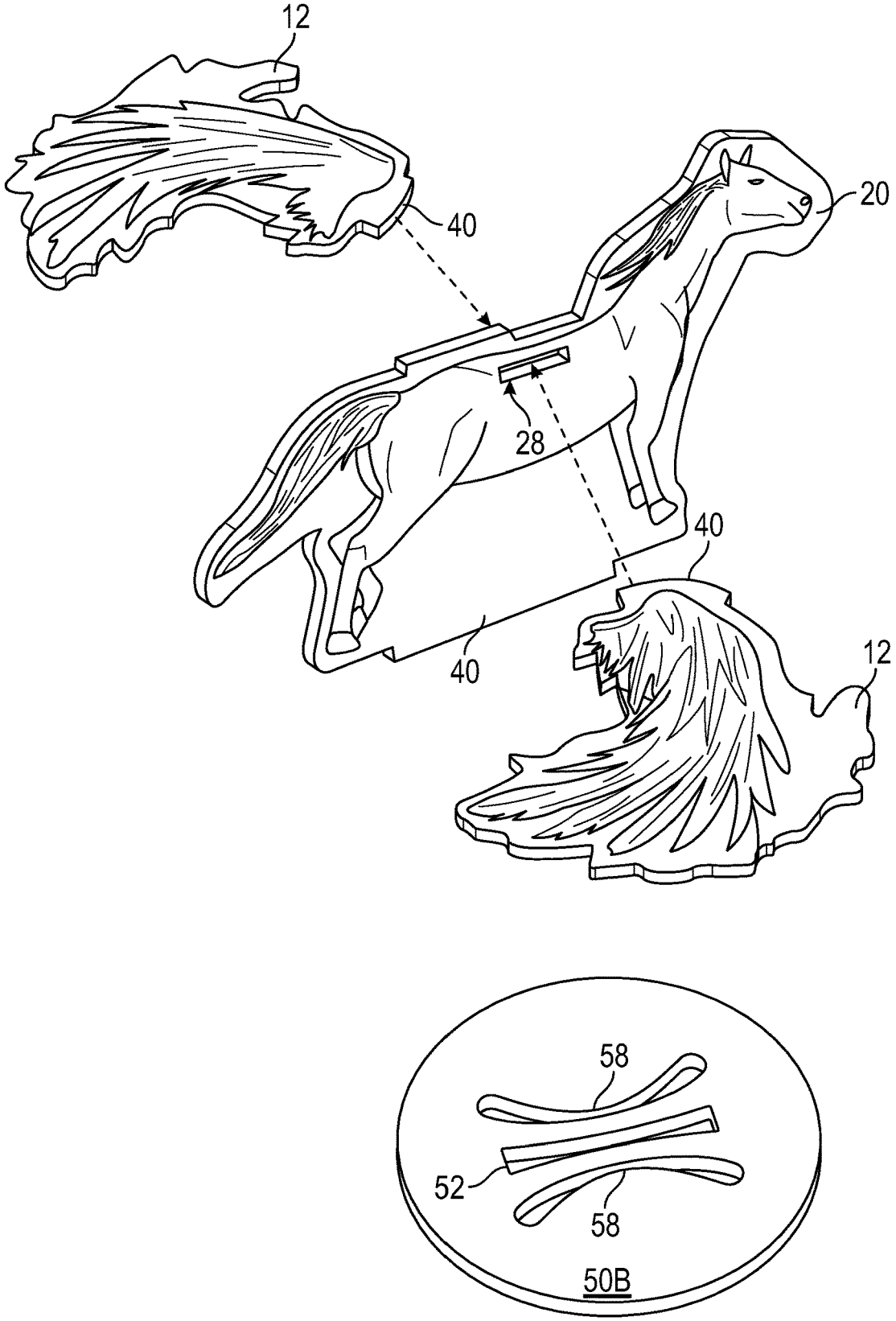

FIG. 9B is al elevation view of the example embodiment shown in FIG. 9A with wings unattached.

Figure 10:
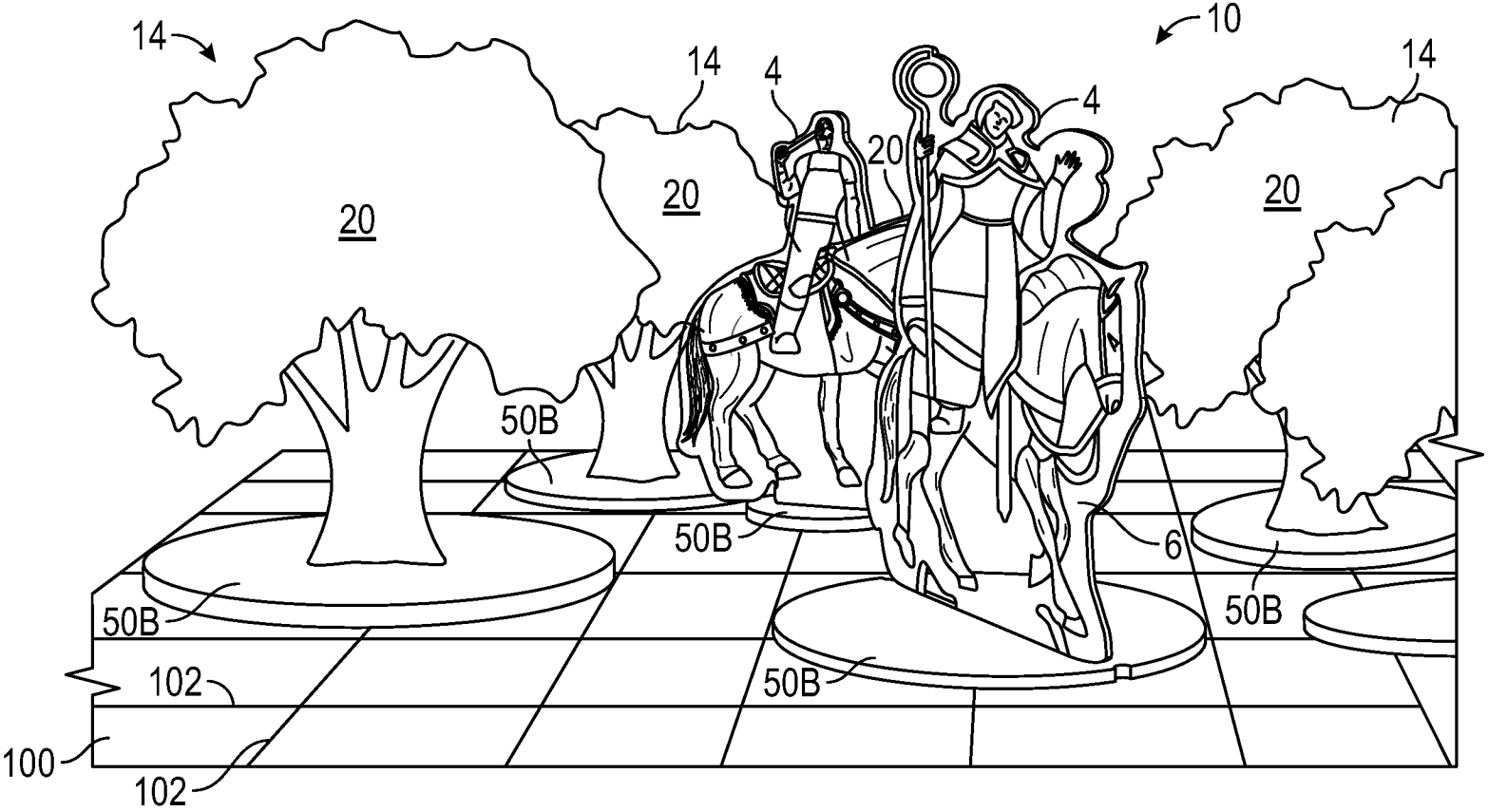

FIG. 10 is an elevation view of an example embodiment of game pieces assembled as riders upon a game space with example embodiments of scene elements (in this case, trees) that increase the realism of the game space.

Figure 11:
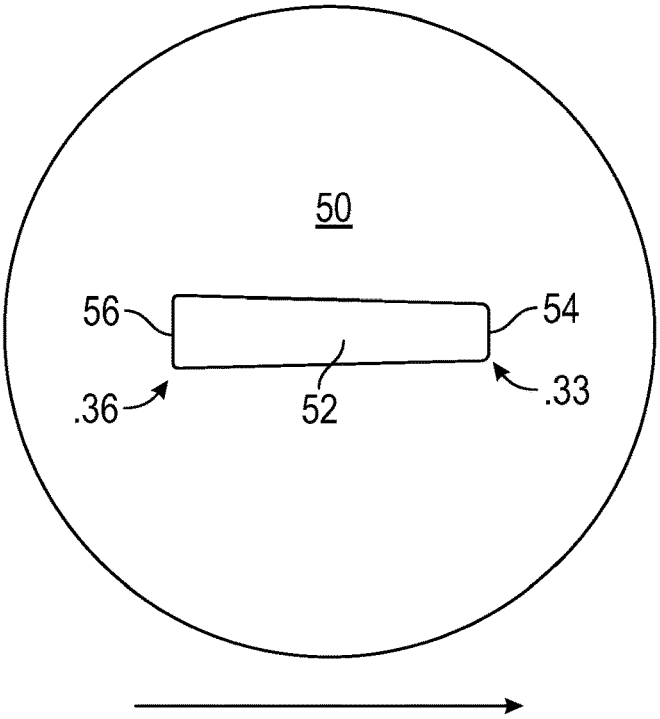

FIG. 11 is an elevation view of an example embodiment of a base portion having a slot disposed therein, which slot narrows from a first end to a second end to enable easy installation and taut engagement of the foot portion of an associated game piece placed therein.

Figure 12:
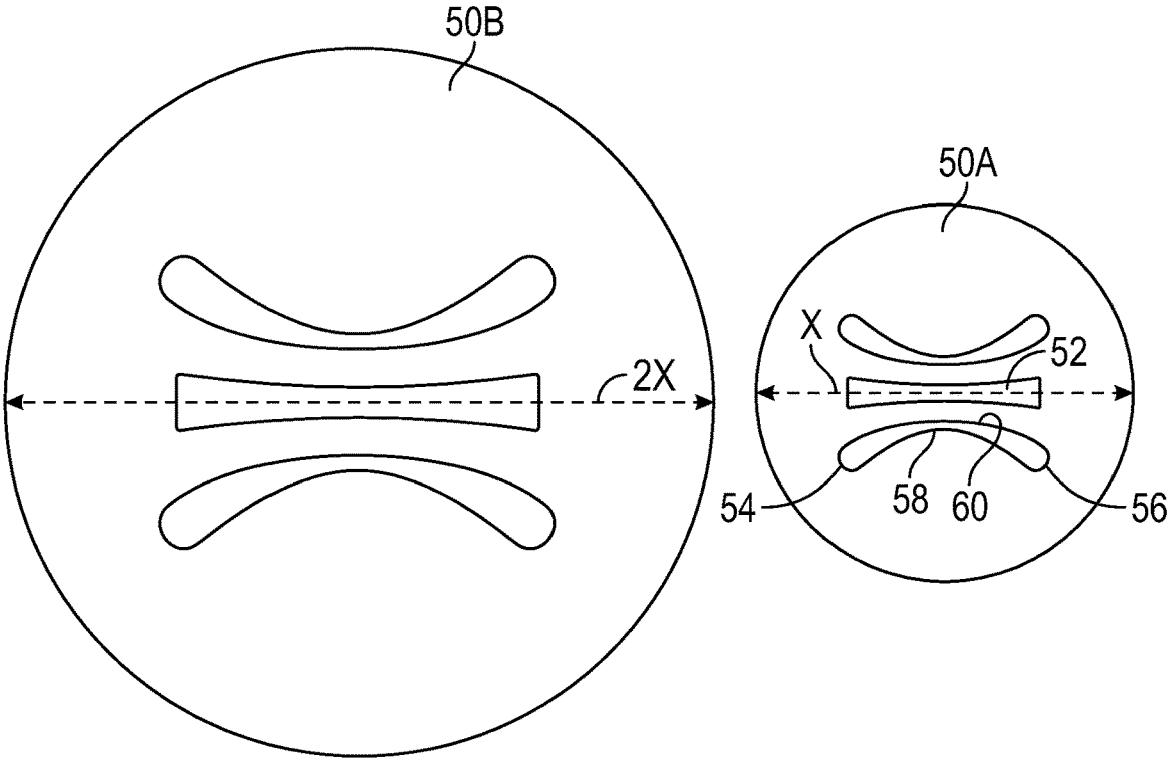

FIG. 12 is an elevation view of an example embodiment of a base portion having a pair of adjacent cuts disposed curved on either side of the slot, each of which adjacent cuts are devised to enable widening of the slot to tautly accommodate foot portions of game pieces that may vary in thickness as a result of the manufacturing process.

Figure 13:
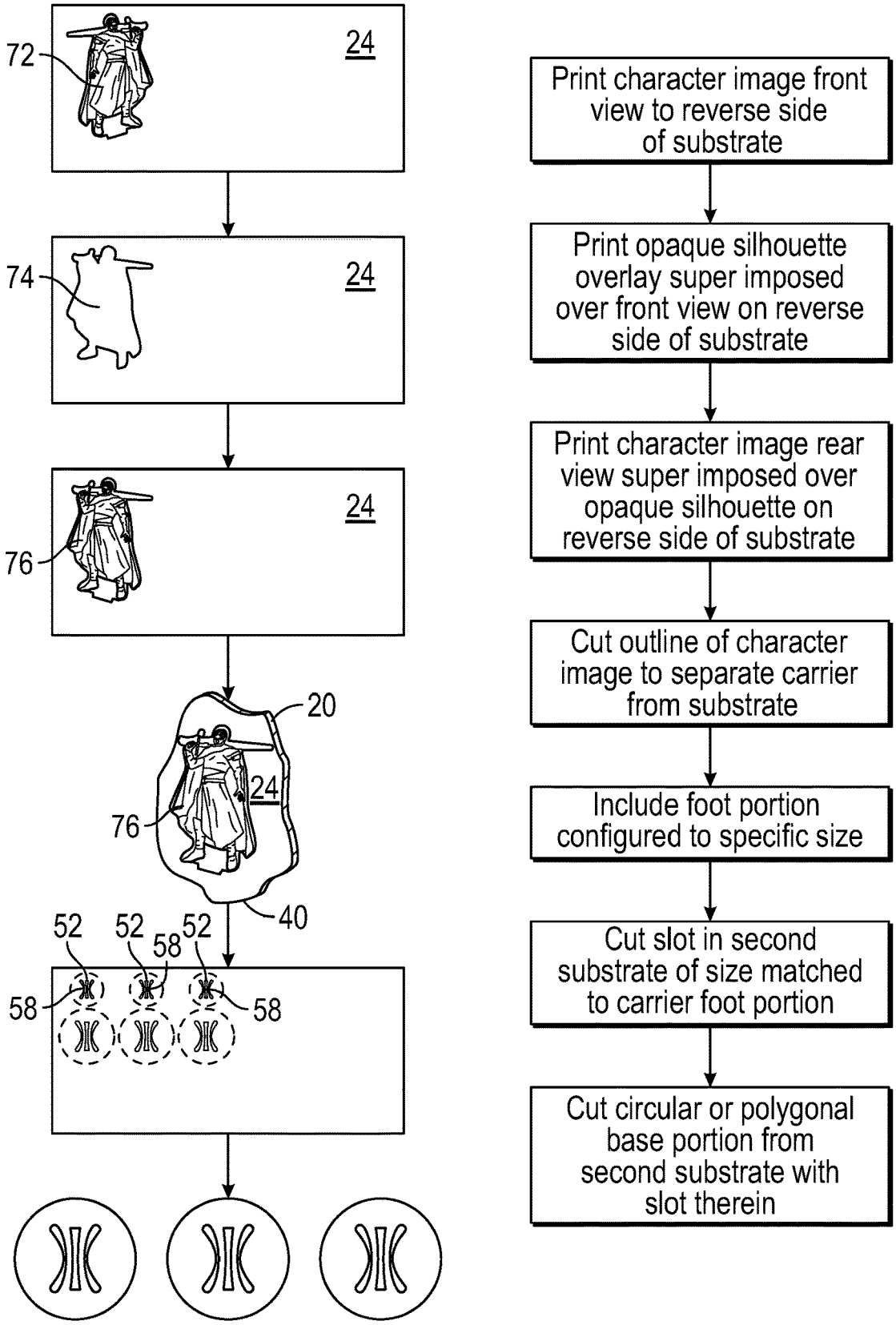

FIG. 13 is a flow diagram illustrating the steps of the method for producing detailed character images disposed upon a carrier to create infinite variety of characters for use in an associated game space.

DETAILED DESCRIPTION OF THE DRAWINGS

With reference now to the drawings, and in particular FIGS. 1 through 13 thereof, example of the instant game piece and method of manufacture employing the principles and concepts of the present game piece and method of manufacture and generally designated by the reference number 10 will be described.

Referring to FIGS. 1 through 13 a preferred embodiment of the present game piece and method of manufacture 10 is illustrated.

FIG. 1A shows an example embodiment of a carrier 20 for a role-playing game piece 10. A generally planar and transparent carrier 20 depicts a character image 70 (in this example depiction, a wizard) and includes an obverse surface 22, a reverse surface 24, a perimetric edge 26 outlining the character image 70 represented on the game piece 10, and a foot portion 40 disposed at a bottom of the perimetric edge 26. The carrier 20 may be made of acrylic, Perspex®, glass, or other transparent or translucent polymer of moldable or cuttable substance that lends itself to such an application as herein described and is typically of the range of 1 to 4 mm thick.

The carrier 20 and base 40 are lightweight and readily portable. When disassembled and lain flat, the carrier 20 and base portion 40 are readily storable between uses and devised for easy mailing as part of a monthly subscription service for subscribing game players or for portage between physical locations where gameplay is to be undertook.

The character image 70 in the form of a wizard in this example is printed on the reverse side of the carrier 20. (Other characters and objects are of course contemplated for depiction on an appropriately sized and shaped carriers.) The character image 70 includes a front view 72 that is printed directly upon the reverse side 24 of the transparent or translucent carrier 20 and depicts the front view of the character image 70 visible through the carrier 20 obverse side 22.

An opaque silhouette overlay 74 (not shown in FIG. 1, see for example FIG. 13) is subsequently printed atop the front view 72 on the reverse side 24 of the carrier 20 to superimpose upon the front view 72 and obscure it from the reverse side 24 of the carrier 20. A rear view 76 of the character image 70, showing the character image 70 from behind, is then printed atop the opaque silhouette 74. The rear view 76 is printed to superimpose upon the opaque silhouette 74 so that the opaque silhouette 74 is not visible at all, effectively superimposed between the front and rear views 72, 76.

A top elevation view of an example embodiment of attachable base portion 50 is shown in FIG. 1B. In this example embodiment, the base portion 50 is discoid, devised of the same material as the carrier 20, and also of the range of 1 to 4 mm thick. In this example embodiment, the base portion 50 has a diameter x. In this example embodiment, the base portion 50 has a slot 52 of length less than diameter x, sized appropriate to tautly engage with the carrier's foot portion 40. The foot portion 40 of the carrier 20 releasably secures into the slot 52 to stand the game piece 10 in an erect position supported upon the discoid base portion 50. The slot 52 in this example embodiment of the base portion 50 is narrowed from a first end 54 to a second end 56 enabling easier seating of the foot portion 40 of the carrier 20 therein. A user inserts one end of the foot portion 40 of the carrier 20 into the first end 54 and then leverages the remaining portion into the second end 56. The narrowing of the slot 52 ensures taut engagement of the foot portion 40 therein.

An alternate embodiment of the base portion 50 is illustrated in FIG. 1C. In this embodiment, at least one curved cut 58 is disposed laterally proximal to the slot 52, in this example embodiment, one cut 58 on either side of the slot 52. In this example embodiment, each cut 58 is curved from a first end 54 to a second end 56 and may be wider at each end 54, 56 that an acme 60 of the curve. Each of the pair of cuts 58 is disposed proximal to the slot 52 to enable a widening of the slot 52 in accommodation of the foot portions 40 of carriers 20 of varying thicknesses, as may occur to a small degree as a result of the manufacturing process. The widening, or flexing, of the slot 52 therefore accommodates the carrier 20 foot portion 40 and tautly engages the carrier 20 in an upright position atop the base portion 50 when the carrier 20 is installed to the base portion 50.

FIG. 2 illustrates the game piece of FIG. 1A in an assembled condition. Carrier 20 is mounted to base portion 40 and the game piece 10 is now positionable within a game space 100 to occupy a location in the game space 100 and represent a player therein. FIG. 3 illustrates the reverse side 24 of the game piece 10 and FIG. 4 illustrates an elevation view of the side of the game piece 10, showing the overall thickness of the carrier 20. As is evident, the carrier 20 and base portion 40 are generally flat, thin, lightweight articles that readily lend themselves to compact storage, portage, and delivery in the mail. The carrier 20 is thus easily stored and transported when disassembled and uninstalled from the base portion 40, and expediently reassembled for game play at a desired gaming location.

FIG. 5 is a front elevation view of an example embodiment of a couple of game pieces 10, 11 assembled and positioned upon an example embodiment of a game space 100. As is illustrated in FIG. 5, the game space 100 may include a board or mat with landforms and/or other designs illustrated thereon (such as an interior or exterior, or other environment wherein game play may operate depending on the narrative at hand). A grid 102 is disposed upon the game space 100, indicative of a location and relative distances between locations. The length of each square of the grid 102 is contemplated to be a unit length of the base portion 40 diameter x whereby the base portion 40 (and the associated game piece 10, 11) are matched to the locations and distances between locations, thereby representing moves. For example, in the example embodiment depicted, game piece 11 has a base that has a diameter 2*x* and therefore covers four squares of the game space 100, indicative perhaps of a greater move ability, size, strength, and/or other characteristic.

FIGS. 6, 7, and 8, illustrate assembly of two game pieces 4, 6 into a single game piece 10. In this example embodiment, a first carrier 6 (a horse in this example, but any other mount would be illustrative) includes a supplemental slot 28 in the carrier 6 for interposition of a second carrier 4 (a rider in this example). In such a manner, a player may acquire additional powers or abilities by joining carriers 4, 6 into a compound game piece 10 (as the rider upon the horse here exemplified). The base portion 40 of the first carrier 6 in this example embodiment may be larger than the base portion otherwise employed by the second carrier 4, and therefore represent an increased move ability, such as double the distance per turn for example, as, in this example illustrated, a horse (or other mount) is able to travel farther and faster than a man (or other rider). In this example embodiment, the supplemental slot 28 of the first carrier 6 is disposed vertically upon the carrier's back into which the second carrier 4 is fittable at right angles.

FIG. 9A illustrates an example embodiment of a carrier 10 able to adopt an additional ability by incorporation of a pair of wings 12 into a horizontally disposed supplemental slot 28. In this example embodiment, the supplemental slot 28 is disposed horizontally upon the carrier 10 and each of a pair of wings 12 is insertable therein to provide a wingspan for the carrier 10. In this example embodiment depicted, the horse, as shown, has become a Pegasus with addition of the wings 12. Such example is illustrative only, and it should be understood that additional abilities and characteristics are contemplated herein as additional to a carrier 10 in like manner, such as the addition of a tool or weapon, say, to a supplemental slot disposed in a particular carrier representing a specific character (such as insertion of a magic sword for a knight, for example, or a staff to a wizard, or an orb, or interchangeable orb, into a staff in the hands of a wizard, as well as other such features, elements, tools, weapons, limbs, accoutrements, apparel, and/or other additionalities as may signify the adoption or attainment of a particular characteristic or ability).

FIG. 9B illustrates the example embodiment of FIG. 9A with the wings 12 disassembled to demonstrate the compact form of the game piece 10 when not assembled.

FIG. 10 illustrates an elevation view of a pair of carrier game pieces 4 mounted to other game pieces 6 and operative in a game space 100 with carriers disposed roundabout as scenic elements 14 and occupying locations in the game space 100. These scenic elements 14 are exemplary only, and additional such game pieces are contemplated as scenic elements 14 including, for example, such as may depict walls, buildings, fire (or flames), portals, doors, and/or derivative parts thereof, and/or other scenic elements useful and adaptable in gameplay to visually represent a storyline, game space, or narrative operative in the game space 100. (Note, the board or mat upon which the game space 100 is articulated may also include design and landscape features for particular squares in the game space, such as, for example, marshes, rivers, holes, traps, mountains, valleys, roads, thickets, etc.)

FIG. 11 is a top elevation view of an example embodiment of a base portion 50 illustrating the narrowed slot 52 embodiment. One end of the slot 52 is a first width and the other end of the slot 52 is second width that is lesser than the width at the first end. FIG. 12 is a top elevation view of a second example embodiment of a base portion 50, including a first base portion 50A and a second base portion 50B having a diameter twice the length of the diameter of the first base portion 50A. In this example embodiment, a curved cut 58 is disposed on either side of the slot 52, laterally proximal to the slot 52, to accommodate a widening and/or flexing of the slot 52 when engaged to the foot portion 40 of a particular carrier 20. As well as ensuring taut engagement of the carrier 20 mounted to the slot 52, the widening of the slot 52 enables accommodation of carrier foot portions 40 that, due to the manufacturing process of the carrier 20, may deviate in thickness slightly.

FIG. 13 is a flow diagram illustrating the steps of the method of manufacturing the game pieces and creating a unique character image 70. A layered image is printed upon a reverse side of a transparent carrier substrate by first printing a front view of the character upon the reverse side of the carrier substrate, which front view is visible through the carrier when viewed from the obverse side. An opaque silhouette, typically white or other neutral shade or hue, of the character image is subsequently superimposed atop the front view to obscure the front view of the character image from the rear side of the carrier substrate. The silhouette is typically white (or other neutral color) to provide a neutral background upon which the colors and details of the character image represented in the rear view will be set to match the colors used in depicting the front view. The rear view of the character image is then superimposed atop the silhouette. The front view and the rear view of the character image are therefore represented in layers disposed on either side of the opaque silhouette, which is not visible in between each of the said front view and rear view of the character image. Viewing the carrier from the obverse side therefore displays the front view of the character image through the carrier. Viewing the carrier from the reverse side therefore displays the rear view of the character image upon reverse side of the carrier.

The carrier is then cut from the substrate by rendering an outline generally conformant with the outline of the character depicted but including a right-angular foot portion at the bottom of the outline for engagement into an appropriately-sized slot disposed in a base portion.

Base portions may be manufactured from separate substrates. At least one slot is cut through the substrate sized appropriate to accommodate the length and thickness of the foot portion of the carrier. The slot may be cut to narrow towards one end. The slot may be cut straight and disposed between cuts disposed laterally proximal on either side of the slot. These lateral cuts are positioned to allow the slot to flex or widen slightly to accommodate the foot portions of varying carriers, which may vary slightly in thickness as a result of the manufacturing process, as well as to ensure taut engagement of the foot portion therein. The base portion is then cut out as a disk or polygon surrounding the slot and, where present, the cuts.

What is claimed is:

1. A role-playing game piece comprising:

a generally planar and transparent carrier, said carrier having:

an obverse surface;

a reverse surface;

a perimetric edge configured in outline of a character form represented on the game piece;

a foot portion projected at a bottom of the perimetric edge;

an image in the form of a being or object printed on the reverse surface of the carrier, said image having:

a front view printed directly upon the reverse surface of the carrier, said front view depicting the character visible through the obverse surface of the carrier;

an opaque silhouette overlay printed atop the front view, said overlay disposed to superimpose upon the front view;

a rear view printed atop the overlay, said rear view printed to superimpose upon the silhouette an image of the character viewed upon the reverse surface of the carrier; and at least one attachable base portion having a slot into which the foot of the carrier releasably secures to stand the game piece in an erect position atop the base portion;

wherein the front view of the image is visible through the carrier and the rear view of the character is depicted upon the reverse surface of the carrier and wherein the perimetric edge is configured to conform to the outline of the image.

2. The game piece of claim 1 wherein the at least one base portion has a unit size corresponding to a maximum move distance the game piece may travel for a single turn upon an associated game board.

3. The game piece of claim 2 wherein the at least one base portion includes additional base portions having sizes configured in multiples of the unit size whereby different maximum move distances the game piece may travel for a single turn upon the associated game board are signified.

4. The game board of claim 3 wherein the game board comprises a grid overlay wherein each square corresponds to the unit distance per move.

5. The game piece of claim 4 wherein the slot in the base portion is wider at one end than the other, wherein the foot is more easily positionable interior to the slot than were the slot a constant width throughout, and wherein the slot more tautly engages the foot portion of the carrier at the narrower end.

6. The game piece of claim 4 wherein the slot in the base portion includes at least one adjacent cut through the base proximal to the slot, wherein the slot is enabled to flex and/or be widened to securely accommodate the foot of the game piece therein.

7. The game piece of claim 1 wherein the game piece further comprises a supplemental slot cut into the game piece wherein an additional game piece or additional element is attachable.

8. The game piece of claim 5 wherein the game piece further comprises a supplemental slot cut into the game piece wherein an additional game piece or additional element is attachable.

* * * * *